US006980666B1

(12) United States Patent
Owen

(10) Patent No.: US 6,980,666 B1
(45) Date of Patent: Dec. 27, 2005

(54) HEADPHONE ASSEMBLY

(76) Inventor: Billie H. Owen, 4580 Old Beatty Ford Rd., China Grove, NC (US) 28023

( * ) Notice: Subject to any disclaimer, the term of this patent is extended or adjusted under 35 U.S.C. 154(b) by 91 days.

(21) Appl. No.: 10/653,139

(22) Filed: Sep. 3, 2003

(51) Int. Cl.[7] ..... H04R 25/00
(52) U.S. Cl. ..... 381/371; 381/381
(58) Field of Search ..... 381/72, 309, 370, 381/371, 373, 374, 376; 455/569.1, 575.2

(56) References Cited

U.S. PATENT DOCUMENTS

| | | | | |
|---|---|---|---|---|
| 3,614,344 | A * | 10/1971 | Gorike | 381/371 |
| 3,778,870 | A * | 12/1973 | Bennett | 24/449 |
| 4,864,619 | A | 9/1989 | Spates | |
| 5,545,859 | A * | 8/1996 | Ullrich | 181/129 |
| 5,625,171 | A | 4/1997 | Marshall | |
| D403,327 | S | 12/1998 | Landreth et al. | |
| D403,681 | S | 1/1999 | Lam | |
| D419,564 | S | 1/2000 | McDonald et al. | |
| D443,261 | S | 6/2001 | Sodergard | |
| 2004/0184635 | A1 * | 9/2004 | Natvig | 381/371 |
| 2004/0197001 | A1 * | 10/2004 | Terrell | 381/370 |

* cited by examiner

*Primary Examiner*—Sinh Tran
*Assistant Examiner*—Brian Ensey

(57) ABSTRACT

A headphone assembly includes a pair of headphones that are operationally coupled together. Each of the headphones includes a housing having a first wall, a second wall and a peripheral wall extending between the first and second walls. A plurality of openings extends into first wall. A sound emitter is mounted within the housing. A tubular member has a first end and a second end. Each of the first and second ends is open. A fastener is adapted for selectively attaching the first end of the tubular member to the peripheral wall of the housing such that the first wall is positioned within the tubular member. Each of the second ends of the tubular members may be selectively positioned over an ear lobe such that the ear lobe is positioned within the tubular member.

8 Claims, 4 Drawing Sheets

HEADPHONE ASSEMBLY

BACKGROUND OF THE INVENTION

1. Field of the Invention

The present invention relates to headset devices and more particularly pertains to a new headset device for positioning headphones adjacent to the ears of a wearer of the headphones without the use of a headband.

2. Description of the Prior Art

The use of headset devices is known in the prior art. U.S. Pat. No. 5,625,171 describes an earpiece which is extendable around the back of an earlobe for positioning of a speaker adjacent to the ear. Another type of headset device is U.S. Des. Patent No. 403,681 having a band which is positioned around the back of the head and also includes a earpiece which is positionable around the lobe of an ear for holding a speaker adjacent to the ear. These types of devices are not comfortable to wear due to their rigid materials and because the speaker moves if the earpiece moves. U.S. Pat. No. 4,864,619 includes a headband which is adjustable for positioning headphone in positions adjacent to the ears of the wearer of the headband. Headbands are not preferred because they can lead to headaches and migraines for those who are required to wear them through a work day.

While these devices fulfill their respective, particular objectives and requirements, the need remains for a device that supports headphones adjacent to the ears of the person using the headphones and does so without a headband and in a manner that is comfortable to the user.

SUMMARY OF THE INVENTION

The present invention meets the needs presented above by providing a headphone assembly that includes a speaker that is coupled to the ear using a tubular member. The tubular member is wrapped completely around the earlobe to distribute weight evenly and to ensure that the speaker does not move away from the ear.

Another object of the present invention is to provide a new headset coupling device that may be retrofitted to existing headphones to convert such from using a headband to using the tubular member.

Still another object of the present invention is to provide a new headset assembly that includes headphone housings having a well therein for receiving the male coupler of a headband so that the user may select between the headband or the tubular member for headphone support.

The this end, the present invention generally comprises a pair of headphones that are operationally coupled together. Each of the headphones includes a housing having a first wall, a second wall and a peripheral wall extending between the first and second walls. A plurality of openings extends into first wall. A sound emitter is mounted within the housing. A tubular member has a first end and a second end. Each of the first and second ends is open. A fastener is adapted for selectively attaching the first end of the tubular member to the peripheral wall of the housing such that the first wall is positioned within the tubular member. Each of the second ends of the tubular members may be selectively positioned over an ear lobe such that the ear lobe is positioned within the tubular member. Alternatively, the tubular member may itself be presented as retrofittable coupling device which may be attached to the housings of headphones for removably attaching the headphones to ear lobes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
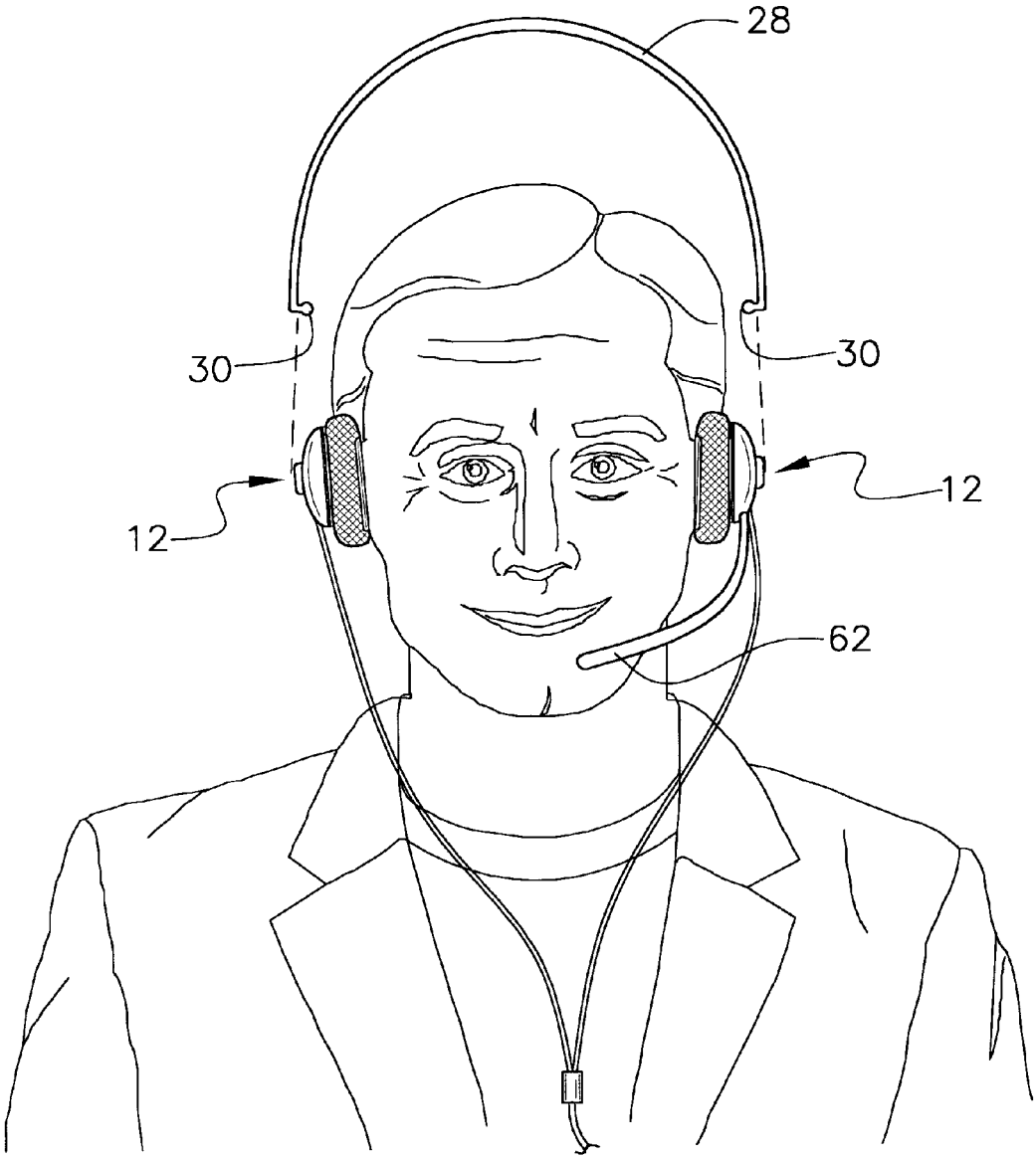
FIG. 1 is a schematic front view of a headphone assembly according to the present invention.
Figure 2:
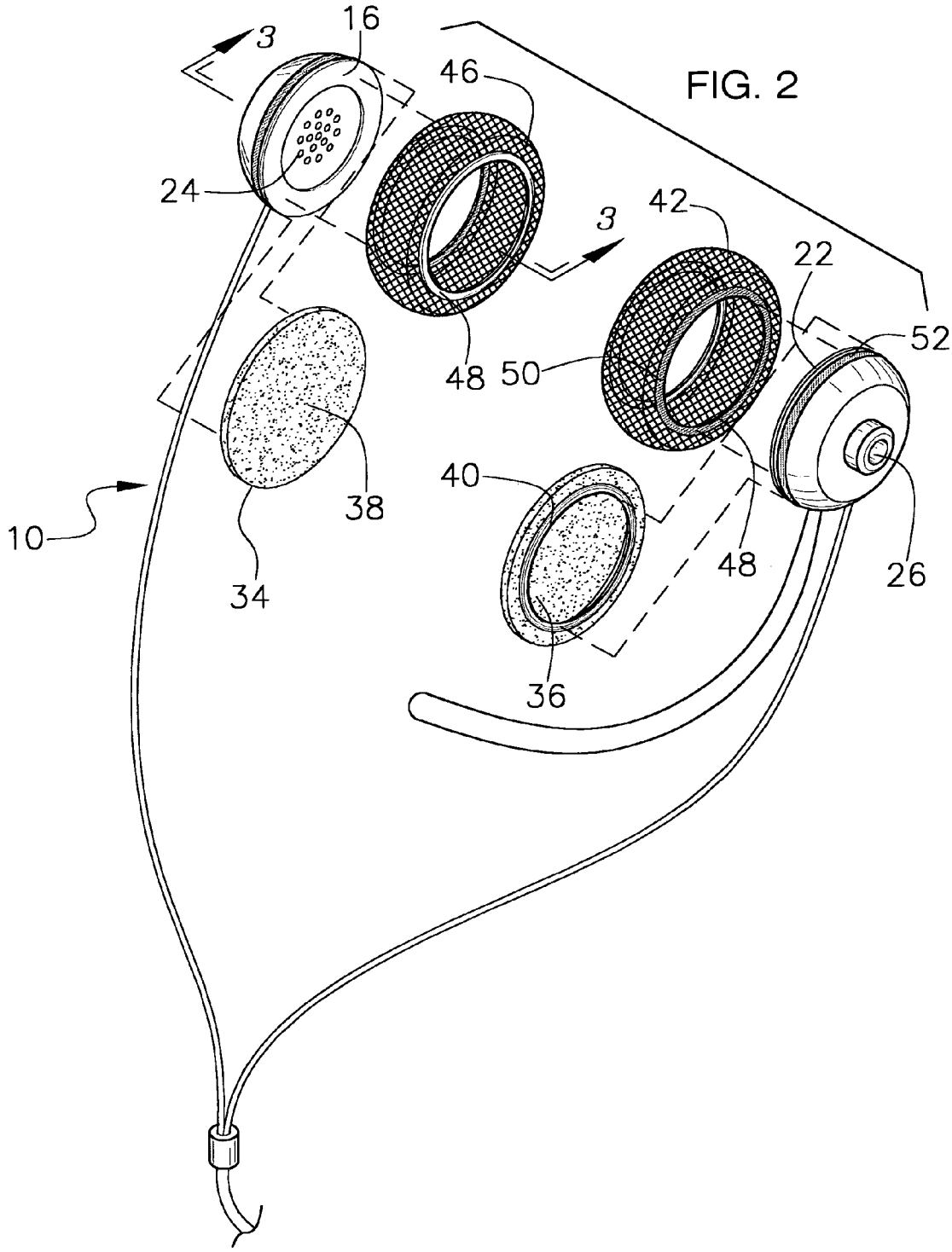
FIG. 2 is a schematic expanded perspective view of the present invention.
Figure 3:
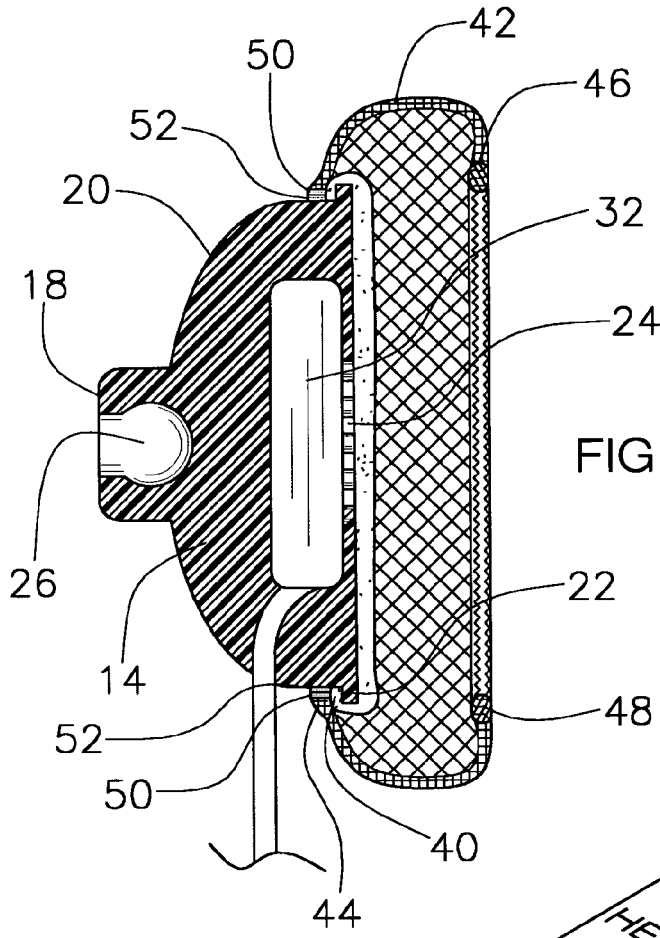
FIG. 3 is a schematic cross-sectional view taken along line 3—3 of FIG. 2 of the present invention.
Figure 4:
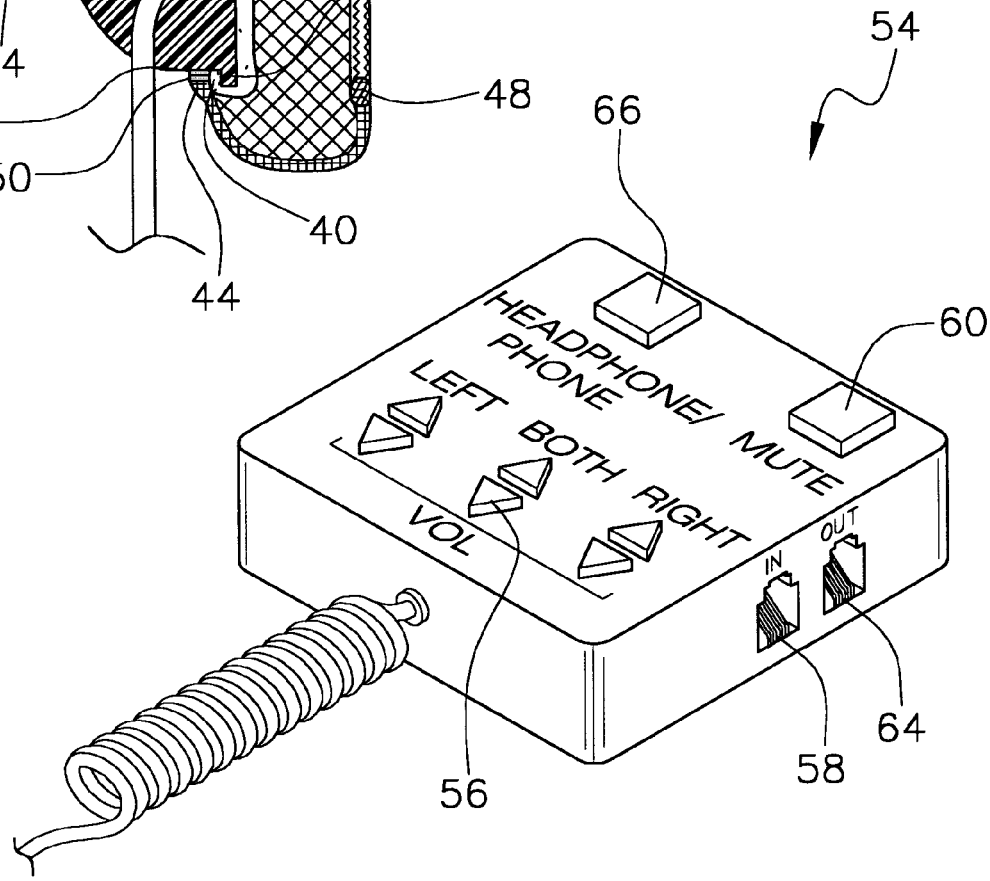
FIG. 4 is a schematic perspective view of the telephone interface of the present invention.
Figure 5:
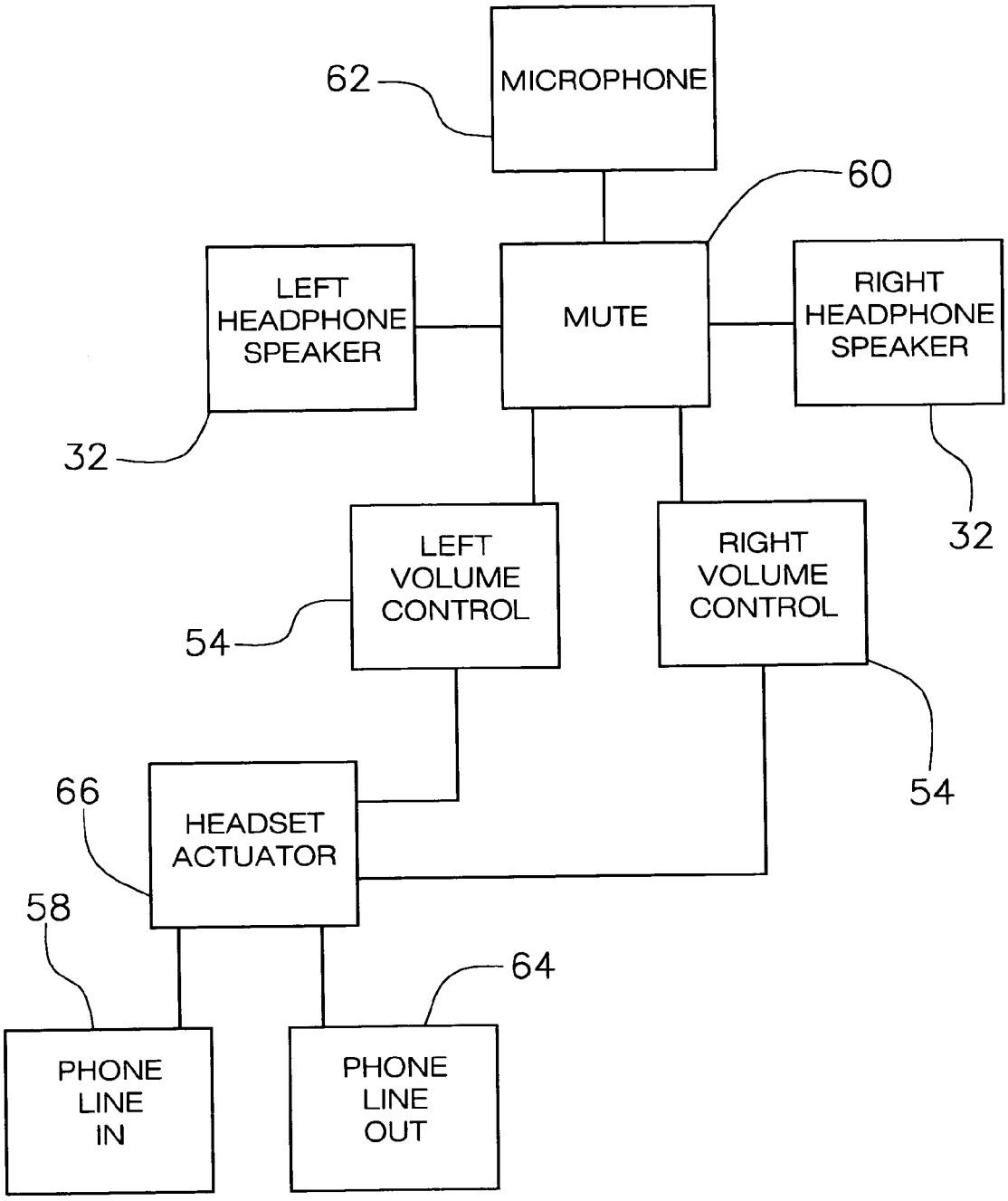
FIG. 5 is a schematic electronic view of the present invention.

With reference now to the drawings, and in particular to FIGS. 1 through 5 thereof, a new headset device embodying the principles and concepts of the present invention and generally designated by the reference numeral 10 will be described.

As best illustrated in FIGS. 1 through 5, the headphone assembly 10 generally comprises a pair of headphones 12. The headphones 12 are operationally coupled together. Each of the headphones 12 include a housing 14 having a first wall 16, a second wall 18 and a peripheral wall 20 extending between the first 16 and second 18 walls. The first wall 16 is preferably circularly shaped. Preferably, a peripheral flange 22 is attached to and extends around an edge of the first wall 16. A plurality of openings 24 extends into first wall 16. A well 26 extends into the second wall 18. The well 26 is preferably bulbous shaped and is adapted for receiving a male coupler ball 30 of a conventional headband 28 if the user desired to use a conventional headband 28. A sound emitter 32, or speaker, is mounted within the housing 14. The openings 24 extend to the sound emitter 32 such that sound emitted from the sound emitter 32 may exit through the openings 24.

Each of the headphones 12 includes a sound permeable covering 34 and a tubular member 42. The covering 34 is removably positioned over the first wall 16. The covering 34 comprises a resiliently compressible material which is ideally a foamed elastomeric material. The covering 34 has a first side 36 and a second side 38. The first side 36 has a peripheral lip 40 thereon. The peripheral lip 40 is selectively extendable over the peripheral flange 22 to hold the covering 34 in position. This allows for easy removal and changing of the coverings 34 for hygienic purposes.

The tubular member 42 has a first end 44 and a second end 46. Each of the first 44 and second 46 ends is open. The tubular member 42 comprises a resiliently elastic cloth material which preferably a mesh material. A resiliently elastic loop 48 is attached to and extends along the second end 46 of the tubular member 42. Each of the tubular members 42 includes a fastener that is adapted for selectively attaching the first end 44 of the tubular member 42 to the peripheral wall 20 of the housing 14 such that the first wall 16 is positioned within the tubular member 42. The fastener preferably includes a hook and loop securing assembly that includes a first mating member 50 attached to and extending along a length of the first end 44 and a second mating member 52 that is attached to and peripherally extends around the peripheral wall 20. If the tubular member 42 is presented independently from the housings 14 of the headphones 12 as a retrofittable coupling device for securing headphones to earlobes, then it is preferred that that the second mating members 52 are removably attachable to the peripheral walls 20 of the housings 14. This may be accomplished using pressure sensitive adhesive.

Though the assembly 10 may be used as conventional headphones, such as for listening to music, it is preferred that assembly includes a conventional interface 54 allowing a user to operationally couple the headphones to a phone line. The interface 54 preferably includes a volume control 56 and a phone jack 58 to which the headphones 12 are operationally coupled. Ideally, the volume control 56 would be adapted to selectively and independently control the volume of sound to the left and right ears and would include a mute actuator 60 for turning off sound to the speakers 32 and for disconnecting a microphone 62 attached to one of the headphones 12. The microphone 62 would also be operationally coupled to the interface 54 so that a user of the assembly 10 would be able to converse over conventional telephone lines using the assembly 10. The interface preferably includes a phone line-out jack 64 so that the interface 54 may be operationally positioned between a telephone and the headset of the telephone. The interface 54 preferably includes a headset actuator 66 so that the user of the assembly may selectively choose between the headphones 12 or the telephone headset.

In use, each of the second ends 46 of the tubular members 42 may be selectively positioned over an ear lobe such that the ear lobe is positioned within the tubular member 42. The tubular member 42 thus holds the housings 14 against the ears without the need of a headband.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A headphone assembly comprising:

a pair of headphones, said headphones being operationally coupled together, each of said headphones including;

a housing having a first wall, a second wall and a peripheral wall extending between said first and second walls, a plurality of openings extending into said first wall;

a sound emitter being mounted within said housing;

a tubular member having a first end and a second end, each of said first and second ends being open;

a fastener being adapted for selectively attaching said first end of said tubular member to said peripheral wall of said housing such that said first wall is positioned within said tubular member;

a peripheral flange being attached to and extending around an edge of said first wall;

a sound permeable covering being removably positioned over said first wall, said covering comprising a resiliently compressible material, said covering having a first side and a second side, said first side having a peripheral lip thereon, said peripheral lip being selectively extendable over said peripheral flange; and wherein each of said second ends of said tubular members may be selectively positioned over an ear lobe such that the ear lobe is positioned within the tubular member.

2. The headphone assembly of said claim 1, wherein each of said second walls of said housings having a well extending therein.

3. The headphone assembly of said claim 1, wherein each of said tubular members comprises a resiliently elastic cloth material.

4. The headphone assembly of said claim 1, wherein each of said fasteners include a hook and loop securing assembly including a first mating member being attached to and extending along a length of said first end a second mating member being attached to and peripherally extending around said peripheral wall.

5. The headphone assembly of said claim 3, further including a pair of resiliently elastic loops, each of said loops being attached to and extending along one of said second ends of said tubular members.

6. The headphone assembly of said claim 5, wherein each of said fasteners include a hook and loop securing assembly including a first mating member being attached to and extending along a length of said first end a second mating member being attached to and peripherally extending around said peripheral wall.

7. The headphone assembly of said claim 1, further including a pair of resiliently elastic loops, each of said loops being attached to and extending along one of said second ends of said tubular members.

8. A headphone assembly comprising:

a pair of headphones, said headphones being operationally coupled together, each of said headphones including;

a housing having a first wall, a second wall and a peripheral wall extending between said first and second walls, a peripheral flange being attached to and extending around an edge of said first wall, a plurality of openings extending into said first wall, a well extending into said second wall;

a sound emitter being mounted within said housing, said openings extending to said sound emitter such that sound emitted from said sound emitter may exit through said openings;

a sound permeable covering being removably positioned over said first wall, said covering comprising a resiliently compressible material, said covering having a first side and a second side, said first side having a peripheral lip thereon, said peripheral lip being selectively extendable over said peripheral flange;

a tubular member having a first end and a second end, each of said first and second ends being open, said tubular member comprising a resiliently elastic cloth material;

a fastener being adapted for selectively attaching said first end of said tubular member to said peripheral wall of said housing such that said first wall is positioned within said tubular member, said fastener including a hook and loop securing assembly including a first mating member being attached to and extending along a length of said first end a second mating member being attached to and peripherally extending around said peripheral wall;

a resiliently elastic loop being attached to and extending along said second end of said tubular member; and wherein each of said second ends of said tubular members may be selectively positioned over an ear lobe such that the ear lobe is positioned within the tubular member.

* * * * *